United States Patent [19]

Rozon

[11] Patent Number: 5,022,453

[45] Date of Patent: Jun. 11, 1991

[54] SLIDING LINK SYSTEM FOR VERTICAL BLINDS

[75] Inventor: David P. Rozon, Russell, Canada

[73] Assignee: 139088 Canada Ltee, Quebec, Canada

[21] Appl. No.: 480,624

[22] Filed: Feb. 15, 1990

[30] Foreign Application Priority Data

Feb. 17, 1989 [CA] Canada ..... 591393

[51] Int. Cl.[5] ..... E06B 9/30

[52] U.S. Cl. ..... 160/168.1; 160/178.1; 160/900

[58] Field of Search ..... 160/178.1, 168.1, 176.1, 160/900, 173, 166.1

[56] References Cited

U.S. PATENT DOCUMENTS 3,343,588 9/1967 Cayton ..... 160/176.1
4,140,169 2/1979 Arena ..... 160/178
4,552,195 11/1985 Durig et al. ..... 160/168.1
4,732,202 3/1988 Anderson ..... 160/168.1
4,791,703 12/1988 Chang ..... 160/178.1 X
4,887,657 12/1989 Spohr ..... 160/178.1

FOREIGN PATENT DOCUMENTS 1097208 10/1981 Canada .

*Primary Examiner*—Blair M. Johnson
*Attorney, Agent, or Firm*—Webb, Burden, Ziesenheim & Webb

[57] ABSTRACT

A vertical blind, having a plurality of vanes and an elongate blind head with a plurality of slidable vane carriers disposed therein, is provided with a plurality of sliding clips linking the carriers, each clip adapted to be fully removable from the carriers. The clips have means to adjust the spacing between the carriers so as to provide a vertical blind capable of fitting within a particular dimension.

9 Claims, 5 Drawing Sheets

SLIDING LINK SYSTEM FOR VERTICAL BLINDS

BACKGROUND OF THE INVENTION

The invention relates generally to vertical blinds of the type in which vanes are suspended from a blind head and are capable of both traversing the head and rotational movement to control the amount of light passing through the blind, and in particular to a system of sliding clips linking the vane-holding carriages within the head.

This application is related to our U.S. patent application No. 301,309, filed Jan. 24, 1989.

Vertical blinds are known wherein individual vanes are suspended from carriages traversing a blind head. The carriages in such a blind are linked together by slidable spacer clips that evenly space the distance between the carriages when the blind is closed. Each of such clips may be slideably linked to a first carriage, to allow the blind to open and close, and fixedly engaged to a second carriage.

It is often desirable to provide means to adjust the spacing between carriages. Often a window blind is required to fit a gap that is not an even multiple of the carriage spacing. Such adjustability may be achieved by providing spacer clips that may be fixedly engaged to a carriage in several alternative positions and fine adjustment of the overall length of the blind may be achieved by selectively spacing a certain number of clips, each of which will be shortened by a small amount from its fully-extended position.

Such adjustability may be achieved if the spacer clip is a separate element from its associated carriage and adapted to engage the carriage in several alternative positions. Our previous Canadian patent application 558,302 discloses one means by which such adjustability may be provided. The present invention provides an alternative means to provide such adjustability.

SUMMARY OF THE INVENTION

The present invention is a sliding clip arrangement for use in a vertical blind having an elongate blind head and vane carriages adapted to traverse the blind head. Each clip has a slot defined by longitudinally-extending side portions and transverse end portions. The clip slideably engages a first of said carriages, with said side portions disposed on opposite sides of a post on said first carriage. The clip has means to fixedly engage a second carriage in alternate positions so as to provide alternate effective slot lengths. These means are comprised of the combination of the post, tabs extending laterally from the clip near one end thereof, and inwardly-projecting members on said second carriage. In a first, maximally-extended portion, the clip is retained by engagement of the post with an end portion of the clip and engagement of the tabs with said members. In a second position the clip is retained by engagement of the tabs with the projecting members.

DESCRIPTION OF THE PREFERRED EMBODIMENT

Figure 1:
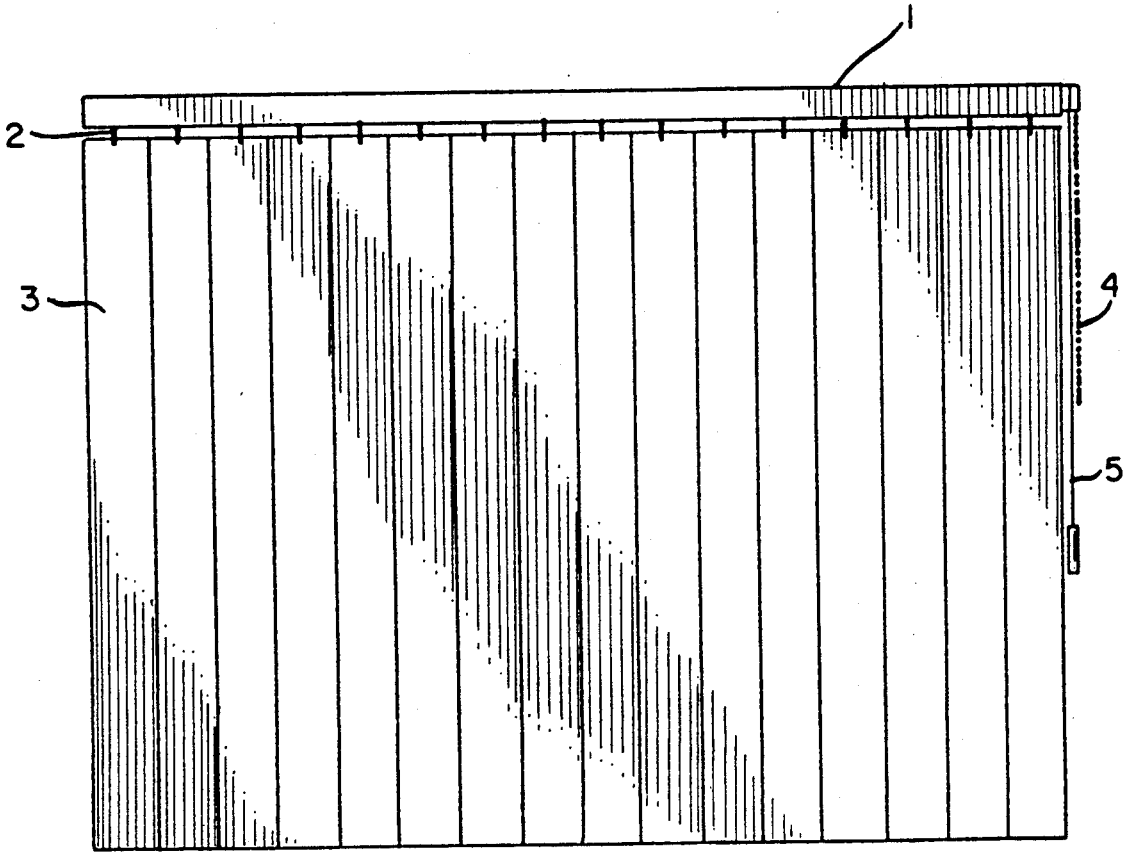
FIG. 1 is a front elevational view of a vertical blind in a fully closed position.

Referring to the drawings in detail, FIG. 1 illustrates a vertical blind in the closed position. The blind is comprised of a head 1 from which depend a plurality of vane clips 2. Individual vanes 3 are attached to each clip 2 and depend downwardly therefrom. A vane-tilting chain 4 and a blind-opening cord 5 are attached to one end of the blind head 1.

Figure 2:
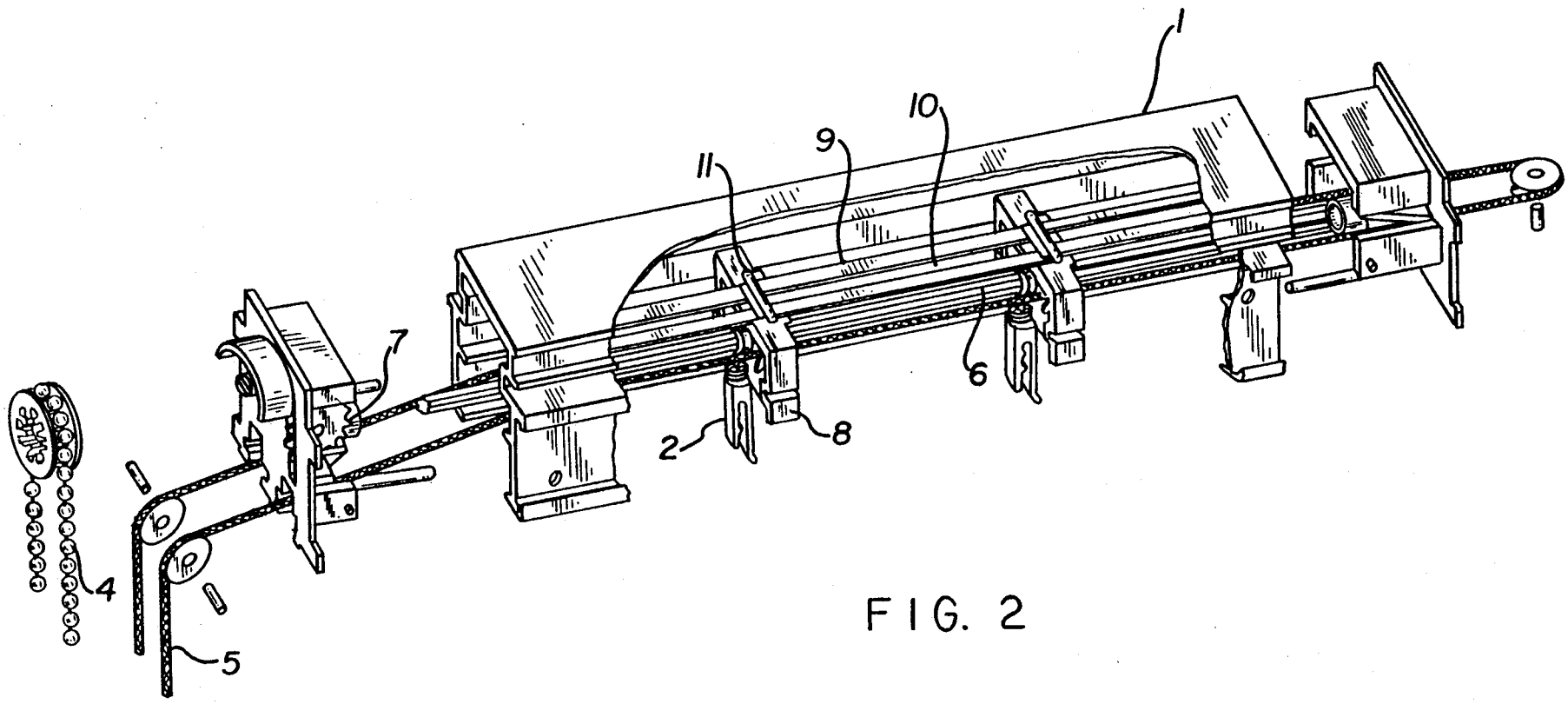
FIG. 2 is an exploded view, in perspective, of a blind head incorporating the present invention.

Referring to FIG. 2, the blind head 1 has a generally box-shaped cross section, the bottom side of which is open. A centrally-disposed tilt rod 6 is rotatably mounted within the blind head 1, and is adapted to be rotated by means of a gear arrangement 7 linked to chain 4. A plurality of vane carriages 8 are adapted to slidably traverse the inside of blind head 1. Each vane carriage 8 is associated with a vane clip 2 depending downwardly therefrom. A gearing means, not shown, within each of the vane carriages 8 converts rotational movement of the tilt rod 6 into rotational movement of the vane clips 2. The vane carriages 8 are linked together by means of spacer clips 9. The carriage 8 closest to the operable portion of cord 5 is engaged to the cord 5, and is here referred to as the "lead carriage". The lead carriage is not visible in FIG. 2 but would be positioned to the extreme left within the blind head. In use, the cord 5 can pull the lead carriage 8 in either direction. Two lead carriages are provided where it is desired to open the blind from the middle.

The spacer clips 9 each engage two neighboring carriages 8. The first such carriage is fixedly engaged to the spacer clip and the second such carriage is slidably engaged thereto. All carriages but the lead carriage are provided with a slidably engaged spacer clip overlying a fixedly engaged spacer clip. The lead carriage has only a slidably engaged spacer clip attached thereto.

In use, the blind may be opened or closed by motivating the lead carriage to traverse the blind head 1, by pulling the cord 5 in an appropriate direction. As the blind is closed, from an open position, the lead carriage is drawn to one side (to the left in FIG. 2) and moves independently of the neighboring carriage for substantially the length of its associated spacer clip. The spacer clip remains stationary while the lead carriage slides relative thereto, until at a predetermined point the spacer clip is drawn sideways along with the lead carriage, drawing with it the neighboring carriage fixed thereto and motivates this neighboring carriage to traverse the blind head 1. The same procedure is repeated for succeeding carriages. To open the blind, the process is reversed. The lead carriage is motivated to traverse the blind head towards the neighboring carriage, the spacer clip sliding freely over the lead carriage until the lead carriage abuts its neighboring carriage. The neighboring carriage is consequently motivated to traverse the blind head, drawing with it its associated fixed spacer clip, and the same process is repeated for the remaining carriages. It will be seen that, in use, the spacer clip bears substantially greater tensile forces than compressive forces.

The spacer clip 9 is flat and elongate and has an elongate slot 10 centrally disposed therein. The spacer clip 9 is rigid, although it may be made from a resilient material such as nylon or acetal. The carriage 8 has a T-shaped post 11 projecting upwardly therefrom, which slidably engages the slot 10 of the clip 9.

Two embodiments of the invention are described herein, differing in the means by which the spacer clip is fixedly engaged to the carriage. Common to the two embodiments are the elements described above.

Figure 3:
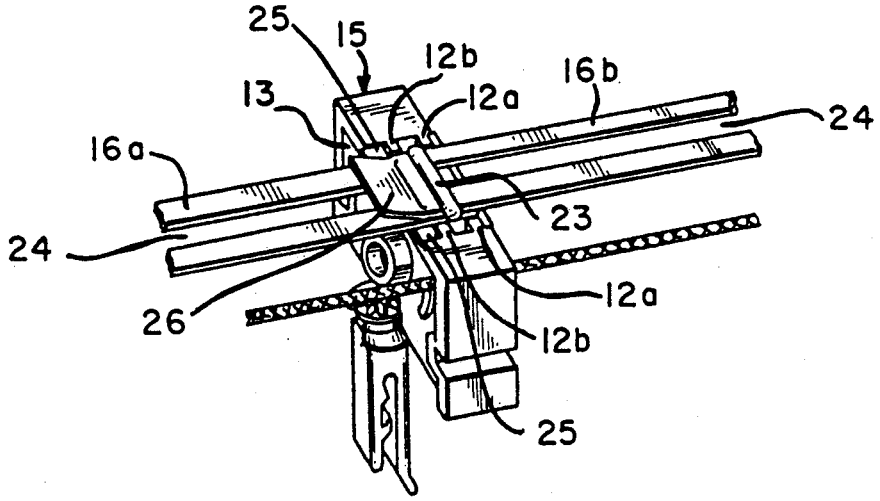
FIG. 3 is a perspective view of a first embodiment of a vane carriage including an associated pull cord, spacer clips, and vane holder.
Figure 4:
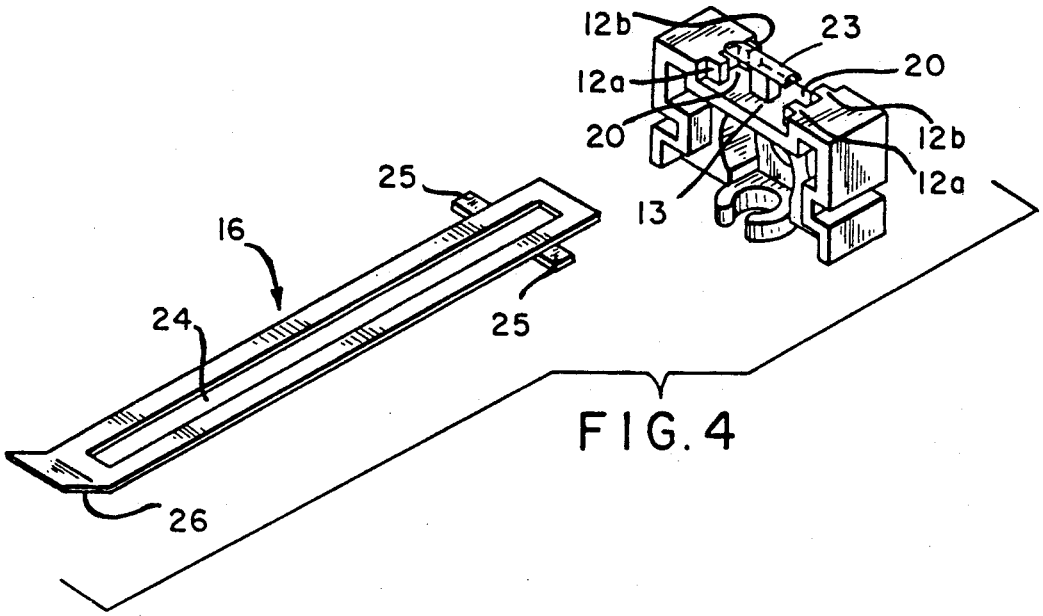
FIG. 4 is a perspective view of a vane carriage and associated spacer clip embodying this first aspect of the invention.

The first embodiment is illustrated in FIG. 3, which shows a vane carriage 15 fixedly engaged to one end of a first clip 16(*a*) and slidably engaged to a second clip 16(*b*). The vane carriage 15 has a recess 13, shown in FIG. 4, adapted to receive the spacer clips 16(*a*) and 16(*b*). Referring to FIG. 4, two adjacent rectangular projections 12(*a*) and 12(*b*) extend laterally from each of the walls of the recess 13. Each rectangular projection 12(*a*) and (*b*) is positioned adjacent the outside edge of the recess 13. Each of the two projections 12(*a*) and (*b*) are spaced apart from each other, leaving a gap 20 therebetween. A T-shaped post 23 extends upwardly from the floor of the recess 13, its top portion transverse to the blind head. The post 23 is adapted to fixedly engage a first spacer clip 16(*a*) to the carriage 15, and to slidably engage a second spacer clip 16(*b*).

Figure 9:
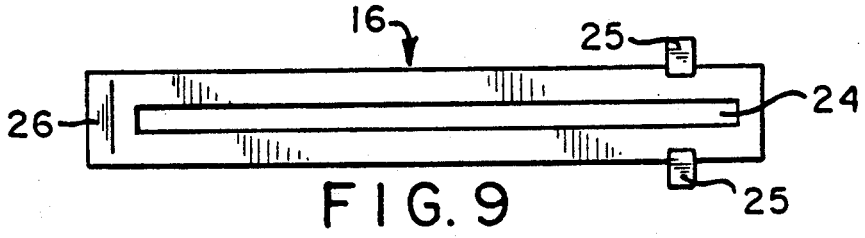
FIG. 9 is a bottom view of a clip.
Figure 10:
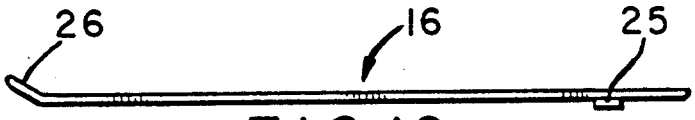
FIG. 10 is a side view of a clip.

Referring to FIGS. 9 and 10, each spacer clip 16 is provided with a longitudinal slot 24 and two opposing square, flat tabs 25 extending laterally from a first end of the clip 16. The tabs 25 are attached to the lower face of the clip 16. The second end of the clip 16 is provided with an upwardly-angled portion 26.

Referring to FIG. 3, the spacer clips are engaged to the carriage by inserting a first clip 16(*a*) on the post 23, and aligning it transversely to the carriage 15. In this position the top portion of the post 23 overlaps the edges of the slot 24 to engage the clip 16(*a*). The clip 16(*a*) is positioned such that the first end of the slot 24 abuts the post 23, and the tabs 25 abut the outside face of the projections 12(*b*). The clip 16(*a*) may be alternatively engaged in a second position, more fully described below, wherein the tabs 25 are positioned between projections 12(*a*) and (*b*). The clip 16(*a*) is placed in this second position by raising it up such that the tabs 25 are brought above the projections 12(*b*), and dropping it into position, such that the tabs 25 are engaged between the projections 12(*a*) and (*b*).

A second clip 16(*b*) is similarly, albeit slidingly, engaged to the carriage by inserting the post 23 through the slot 24, and turning the clip 16(*b*) 90°, such that it overlies and points in the same direction as the first clip 16(*a*), and serves as a cap to prevent the first clip 16(*a*) from lifting up and disengaging from its fixed position. It will be seen that one end of the second clip 16(*b*) overlies one end of the first clip 16(*a*). Both clips 16(*a*) and (*b*) are engaged at one end thereof to the post 23, the first clip 16(*a*) being engaged at the first end and the second clip 16(*b*) at the second end.

Figure 5:
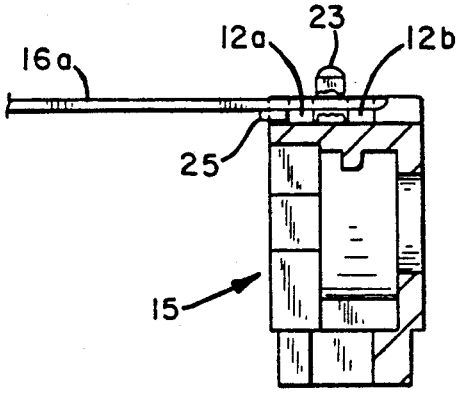
FIG. 5 is a cross-sectional view of a carriage and clip, illustrating the clip engaged in its maximally-extended position.
Figure 6:
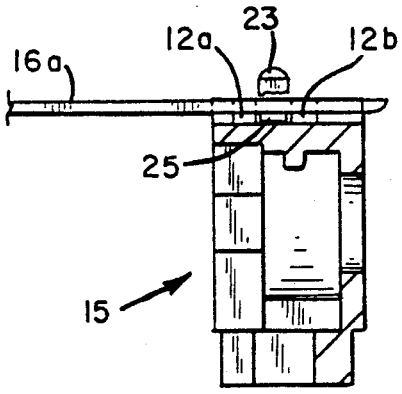
FIG. 6 is a cross-sectional view as in FIG. 5 illustrating the clip engaged in a shortened position.
Figure 8:
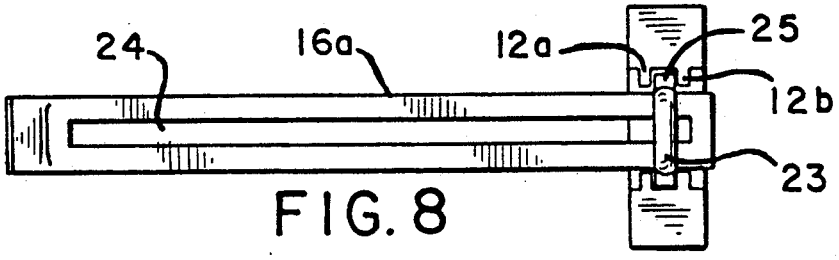
FIG. 8 is a top view of a carriage and clip in the position shown in FIG. 6.
Figure 7:
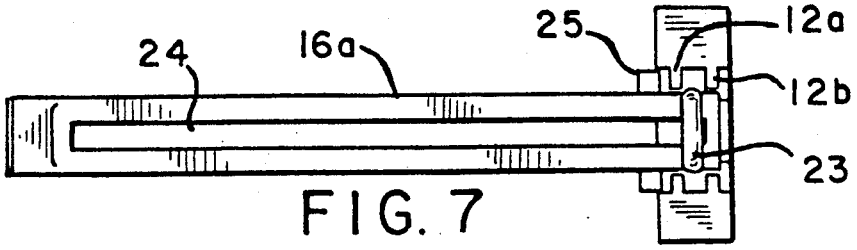
FIG. 7 is a top view of a carriage and clip in the position shown in FIG. 5.

As mentioned, the clip 16(*a*) may be fixedly engaged to the carriage 15 in two alternative positions, resulting in two different spacings between the carriages. The two positions, illustrated in FIGS. 5, 6, 7 and 8 provide different spacings between neighboring carriages by effectively shortening or lengthening the spacer clip 16(*a*). The first position, illustrated in FIGS. 5 and 7, provides a maximum extension of the spacer clip 16(*a*). The spacer clip 16(*a*) is positioned such that each tab 25 abuts an outwardly-facing side of a corresponding projection 12(*a*), and is thus prevented from sliding to the right. The spacer clip 16(*a*) is prevented from sliding to the left, away from the projections 12(*a*) and (*b*), by the abutment of the end of the slot 24 against the post 23. The post 23, tabs 25, rectangular projections 12(*a*) and the slot 24 thus cooperate to fixedly engage the spacer clip 16(*a*) to the carriage 15 in a first position. The second position, illustrated in FIGS. 6 and 8, provides a shortened extension of the spacer clip 16(*a*) by positioning it, in FIGS. 6 and 8, further to the right relative to the first position. Each tab 25 is positioned in the gap between the projections 12(*a*) and (*b*), which are suitably positioned to snugly hold the tab 25 therebetween. The tabs 25 are thus prevented from sliding in any direction. The spacer clip 16(*a*) is thus fixedly engaged to the carriage 15 by the projections 12(*a*) and (*b*) and the post 23, cooperating with the tabs 25 and the slot 24.

Referring to FIG. 3, a second spacer clip 16(*b*) identical to the spacer clip 16(*a*) overlies the spacer clip 16(*a*) and extends outwardly from the carriage 15. The spacer clip 16(*b*) is engaged to the carriage 15 by engagement of the post 23 with the slot 24. In use, the spacer clip 16(*b*) is slidable relative to the carriage 15 within the limits defined by the slot 24. The upwardly-angled portion 26 assists the spacer clip 16(*b*) to slide over the spacer clip 16(*a*). The other end of spacer clip 16(*b*) is fixedly attached to the next carriage (not shown) to the right of carriage 15.

Figure 11:
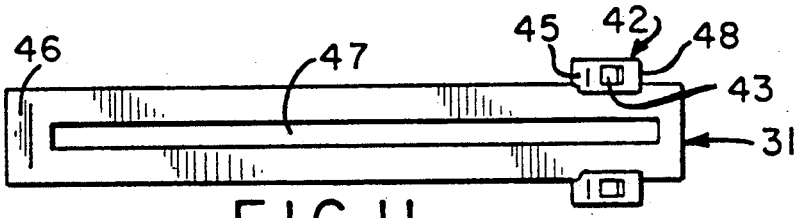
FIG. 11 is a bottom view of a clip according to a second embodiment of the invention.
Figure 12:
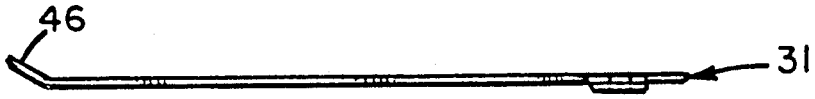
FIG. 12 is a side view of a clip according to this second aspect.
Figure 13:
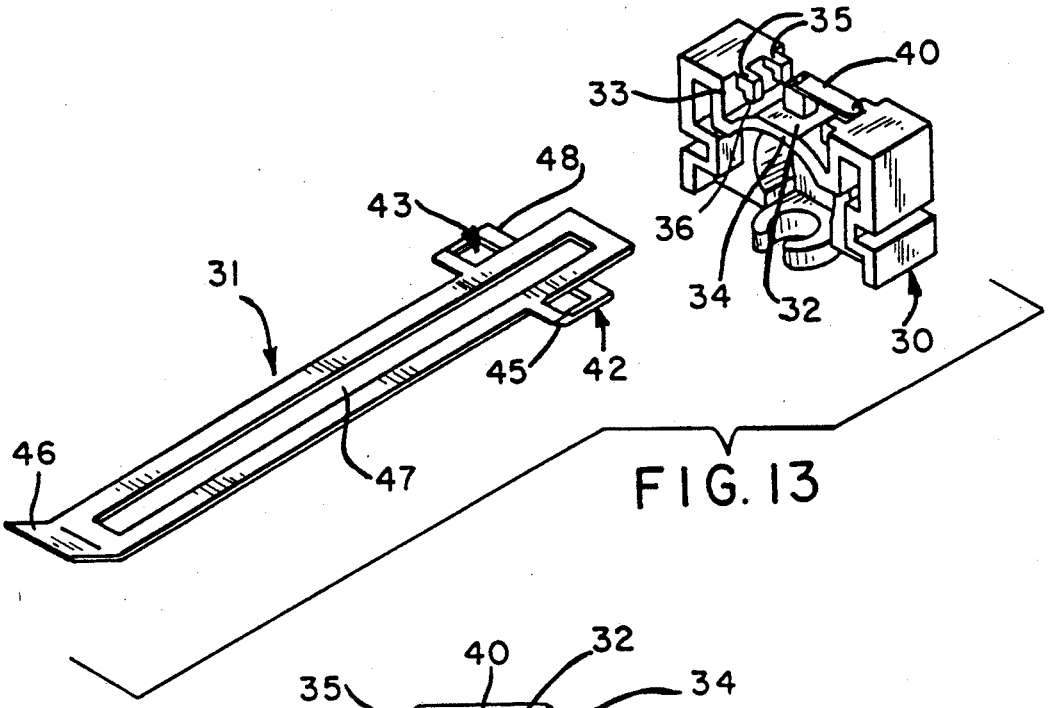
FIG. 13 is a perspective view of a carriage and clip embodying this second aspect.

A second embodiment of the invention is illustrated in FIGS. 11 through 16. A carriage 30 and spacer clip 31 embodying this second aspect are illustrated in FIG. 13.

Figure 14:
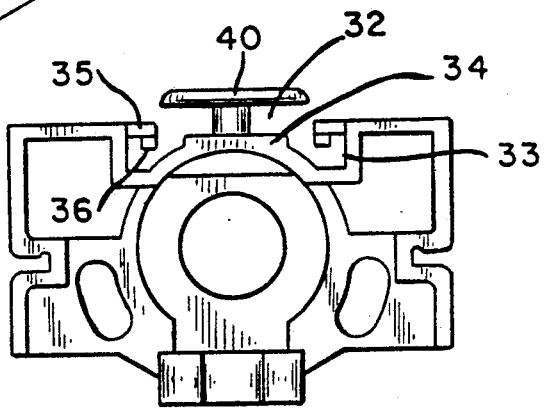
FIG. 14 is a front elevational view of a carriage according to this second aspect.
Figure 15:
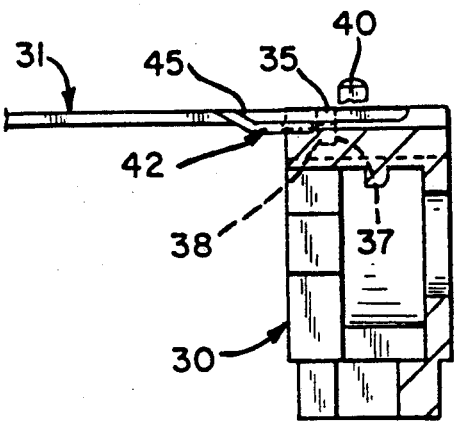
FIG. 15 is a cross-sectional view of a carriage and clip according to this second aspect illustrating the clip engaged in its maximally-extended position.

Referring to FIG. 14, the top surface of a carriage 30 is provided with a recessed portion 32, having sidewalls 33. The recessed portion has a central bulge 34 that accommodates a gear mechanism, not shown, and provides a support platform to elevate the association spacer clips. Two elbow-shaped protrusions 35 extend laterally from each of the sidewalls 33 of the recess 32, the free ends 36 thereof depending downwardly. Referring to FIG. 15, each protrusion 35 has a partly-angled outer face 38, having an inwardly-sloping portion commencing partway down the face thereof, and a square inner face 37. A T-shaped post 40 extends upwardly from the central bulge 34.

Referring to FIGS. 11 and 12, spacer clips 31 are provided, each having a slot 47 and two rectangular tabs 42 extending laterally from respective sides of a first end of the spacer clip 31. The tabs 42 extend from the lower surface of the spacer clip 31, and are generally flat. Each tab 42 has a downwardly slanting front face 45, an aperture 43 and a square rear face 48. The second end of the spacer clip 31 is provided with an upwardly-angled portion 46.

Figure 16:
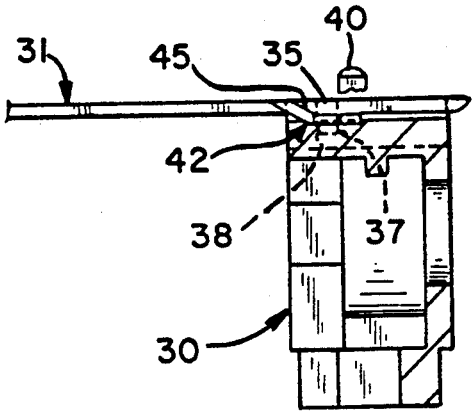
FIG. 16 is a cross-sectional view as in FIG. 15 illustrating the clip engaged in the shortened position.

Referring to FIGS. 15 and 16, the spacer clip 31 may be fixedly engaged to the carriage 30 in two alternative positions. The spacer clip 31 is fixedly engaged to the carriage by generally the same procedure as in the first embodiment. The angle of the front faces 45 of the tabs 42 allows the tabs to be pulled over the tops of the protrusions 35 without engaging them, to allow the user to bring the rear faces 48 into abutment with the protrusions 35. In the first, maximally-extended position illustrated at FIG. 15, the post 40 engages the slot 47 of the spacer clip 31. The rear face 48 of each tab 42 abuts the partly-angled face 36 of a corresponding protrusion 35. The spacer clip 31 is consequently held in position by the cooperation of the post 40, the rear face 48 of the tab 42 and the face of the protrusion 35. The spacer clip may subsequently be manipulated into a second, shortened position, illustrated in FIG. 16. Each aperture 43 of the tab 42 engages the free end 36 of a protrusion 35, and is fixedly engaged thereby. The spacer clip is brought into this second position by pressing it forcefully backwards, such that the tabs 42 are forced under the ends of the protrusions 35. The partly-angled face 36 acts to flex the clips sufficiently to allow the tabs 42 to pass under the free ends of the protrusions 35. When the apertures 43 are aligned with the protrusions 35, the spacer clips snap back into position, the protrusions 35 and the central bulge 34 cooperate to firmly engage the apertures 43. Two pairs of protrusions 35 are provided on each carriage 30, to allow the spacer clip to be fixed thereto such that it may extend outwardly in either direction.

This second embodiment allows the user to adjust the spacing of the carriages in an assembled blind, and consequently no prior calculations are required to calculate the number of spacer clips that must be shortened. The user simply shortens the requisite number of spacer clips in the already-installed blind head.

In either position described above, a second spacer clip, not shown, overlies the first spacer clip 31 and is slidably engaged to the post 40 in the same manner as in the first embodiment hereof. In the first maximally-extended position, the second spacer clip serves as a cap for the first spacer clip 31.

In either embodiment of the invention, the spacer clip fixedly engaged to the carriage may be adapted to project from either side of the carriage, thereby allowing the same type of carriage and spacer clips to be used in blinds, whether such blinds are arranged to open from either side or centrally.

It will be understood that although preferred embodiments of the invention have been described and disclosed herein, various alterations can be made thereto without departing from the true spirit and scope of the invention as defined by the appended claims.

What I claim as my invention is:

1. In a vertical blind arrangement having an elongate blind head and vane carriages adapted to traverse said blind head, an arrangement of sliding clips for adjustably spacing said carriages, each clip having a slot defined by longitudinally extending side portions and transverse end portions and slidably engaging a first of said carriages with said side portions disposed on opposite sides of a post on said first carriage, and means to fixedly engage a second carriage in alternate positions so as to provide alternate effective slot lengths, said means comprising the combination of said post, tabs, extending laterally from said clip near one end thereof, and inwardly projecting members on said second carriage whereby, in a first, maximally-extended position, the clip is retained by engagement of said post with an end portion at said one end of said clip and by engagement of said tabs with said members; whereas, in a second position, the clip is retained by engagement of said tabs with said projecting members.

2. An arrangement as claimed in claim 1 wherein said sliding clip may be engaged to said first carriage so as to extend outwardly from either side thereof.

3. An arrangement as claimed in claim 1 wherein said tabs extend from a lower face of said clip.

4. An arrangement as claimed in claim 1 wherein each of said carriages is provided with a recess having generally vertical side walls for receiving at least one of said clips, and said inwardly-projecting members extend laterally from said side walls.

5. An arrangement as claimed in claim 2 having two adjacent inwardly-projecting members on each side of said carriage.

6. An arrangement as claimed in claim 5 wherein said tabs are comprised of square projections, adapted to be positioned between said adjacent inwardly-projecting members when said sliding clip is in said second position.

7. An arrangement as claimed in claim 1 or 5 wherein a second clip is positioned to partly overlie said clip and retain the tabs thereof between the projecting members, said second clip being slidingly engaged to the post of said second carriage.

8. An arrangement as claimed in claims 1 or 5 wherein the said inwardly-projecting members are generally elbow-shaped, with downwardly projecting free ends, and said tabs are provided with apertures adapted to engage said free ends.

9. An arrangement as claimed in claim 8 wherein said inwardly-projecting members are partially tapered on a lower portion thereof, said taper provided on at least one face thereof.

* * * * *